US006138827A

United States Patent [19]

Marshall

[11] Patent Number: 6,138,827

[45] Date of Patent: Oct. 31, 2000

[54] TOOL ATTACHMENT FOR CRATE

[76] Inventor: Jeff Marshall, 37 Planetree La., St. James, N.Y. 11780

[21] Appl. No.: 09/290,910

[22] Filed: Apr. 12, 1999

[51] Int. Cl.[7] ..... B65D 85/20

[52] U.S. Cl. ..... 206/373; 220/735; 383/39

[58] Field of Search ..... 206/372, 373, 206/349, 374–379, 806; 150/161; 383/38, 39; 211/70.6; 220/735

[56] References Cited

U.S. PATENT DOCUMENTS

| | | | |
|---|---|---|---|
| D. 345,237 | 3/1994 | Stein | D32/53 |
| D. 355,062 | 1/1995 | Maire et al. | D32/53 |
| D. 358,937 | 6/1995 | Duckworth | D3/306 |
| D. 388,919 | 1/1998 | Maire et al. | D32/53 |
| 4,765,472 | 8/1988 | Dent | 206/373 |
| 4,773,535 | 9/1988 | Cook | 206/373 |
| 4,925,026 | 5/1990 | McKay | 206/373 |
| 4,993,551 | 2/1991 | Lindsay | 206/373 |
| 5,174,447 | 12/1992 | Flemming | 206/373 |
| 5,813,530 | 9/1998 | Kornblatt | 206/373 |
| 5,833,095 | 11/1998 | Russell et al. | 206/373 |
| 5,988,383 | 11/1999 | Armstrong | 206/373 |

*Primary Examiner*—Jacob K. Ackun
*Assistant Examiner*—Luan K. Bui

[57] ABSTRACT

A tool holding attachment for crate device comprising a crate with an exterior surface and an interior surface, the crate comprising an upper lip portion and a plurality of handle apertures located at an upper portion of the crate exterior surface. The exterior surface and interior surface comprise a plurality of apertures. A tool holding attachment device comprises outer pockets and inner pockets thereon and is draped over the crate upper lip portion and removably attached to the crate. The tool holding attachment device functions to removably receive multiple tools and implements therein. A pocket attachment means functions to allow the outer pockets and inner pockets of the tool holding attachment device to be removably attached to the tool holding attachment device. An anchoring means functions to secure the tool holding attachment device to the crate to prevent slippage therewith. In the preferred mode, the tool holding attachment device is generally pliable, drapes over a traditional milk crate, and comprises multiple outer and inner pockets of varying size and capacity to removably store tools and implements for a variety of tasks.

20 Claims, 3 Drawing Sheets

TOOL ATTACHMENT FOR CRATE

BACKGROUND OF THE INVENTION

1. Field of the Invention

The present invention is pliable tool holding apparatus that is removably attachable to a rectangular crate with an open top portion, such as a standard milk crate. Accordingly, the device of includes multiple handles within the main walls of the crate, allowing the user to carry heavy loads with both hands. In addition, the device may include a means to removably attach the tool holder to the crate by way of the holes embodied within in the standard crate side walls, functioning to keep the holder from slipping along the outer or inner edge of the crate. Moreover, the present invention may include separate removable compartments, and may include a varying quantity of compartments or pockets, of varying sizes and configurations, each suitable for particular tools and implements.

2. Description of the Prior Art

Numerous innovations for tool carrying devices have been provided in the prior art that are described as follows. Even though these innovations may be suitable for the specific individual purposes to which they address, they differ from the present invention as hereinafter contrasted. The following is a summary of those prior art patents most relevant to the invention at hand, as well a description outlining the differences between the features of the present invention and those of the prior art U.S. Pat. No. 4,993,551, Invented by Lindsay, Titled "Tool Holder For Bucket"

In the patent to Lindsay, a tool holder and storage device to interfit over the upper rim of a five gallon bucket is provided. The device includes a tubular cloth panel which drapes and conforms over the inside and outside surfaces of the bucket with inner pockets sewn on the panel to drape on the inside of the bucket and outer pockets sewn on the panel to drape on the outside surface of the bucket with slots cut lengthwise from an end of the cloth panel of sufficient length to allow the panel to drape downwardly around the handle ends of the bucket on the outside surface with ties between the edges of the slots to fix the device under the handle ends.

U.S. Pat. No. 4,773,535, Invented by Cook, Titled "Portable Tool Case"

In the patent to Cook, a portable tool case has at least two canvas panels attached together. Each panel includes at least one, and preferably a plurality of, tool holding pockets, each pocket for holding a single tool. In one embodiment, two panels are hingedly attached together along a mating edge such that the case can be draped over a sawhorse, protective railing, etc., a panel hanging on each side of the sawhorse. The tool holding pockets are located on the exterior surfaces of the panels, as the case rests on the sawhorse, and support tools of a particular trade in fully exposed and easily accessible manner. The two panels may be attached together and the case easily transported by hand by a handle located on the hinged attachment of the two panels. A second embodiment resembles a portfolio or attache case. The two panels comprising the tool case have the plurality of tool holding pockets on the interior sides of the panels, such that the tools can be enclosed when the case is folded over and closed. A third embodiment encloses a top horizontal panel and four vertical panels defining an open-bottom boxlike device. This embodiment is adapted to fit down over, and be supported on top of, a stepladder. Three or more of the vertical panels each include at least one tool holding pocket. This embodiment, fully loaded with tools, may be easily carried about by the handle on the top panel.

U.S. Pat. No. 5,833,095, Invented by Russell, et. al., Titled "Tool and Fastener Holder with Detachable Holding Belt"

The patent to Russell describes a tool and fastener holder with detachable holding belt to both of which a plurality of male couplers are affixed and able to line a bucket both inside and out and both holder and belt each being amenable to receipt of a plurality of detachable pouches containing various species of fasteners, one species per pouch with the belt able to via a plurality of tool holding components detachably hold various hammers, crowbars, screwdrivers and the like.

U.S. Pat. No. 5,174,447, Invented by Fleming, Titled "Implement Retainer"

The patent to Fleming describes a tool carrier for use with open top containers formed initially as a rectangular blank having side edges sewn together to form a cylinder. The cylinder is inserted within the open top area of the container and oriented to be draped on both interior and exterior side walls of the container. Thus, the tool carrier forms inner and outer sheaths upon which a plurality of tools can be carried. The tools are carried on the inner and outer sheaths by means of pockets and loops through which the tools or a portion thereof are to pass.

U.S. Pat. No. 4,925,026, Invented by McKay, Titled "Tool Holder Insert for a Bucket"

In the patent to McKay, a container is provided with an insert having an inner surface to which are affixed spiral springs which frictionally engage and hold tools inserted therebetween. A cabinet is slidably mounted on the wall component to carry an assortment of small items in cabinet drawers. The cabinet and an interchangeable holder component are removably attached to the insert wall component by spaced apart guides. A tray is positionable in the bottom of the container.

U.S. Pat. No. 4,765,472, Invented by Dent, Titled "Bucket Attachment Tool Holder"

The patent to Dent describes a bucket attachment tool holder for mounting on a conventional bucket having a loop handle. The tool holder includes an elongate piece of flexible material formed with pockets on one side thereof for receiving and holding tools, hook and loop fastener elements disposed near each end of the piece of material, but on opposite sides, for joining the ends together when the piece of material is wrapped around the exterior side walls of a bucket, and two snap hooks disposed on the piece of material at spaced-apart locations near or on a top edge thereof for attaching to the handle of the bucket. When the tool holder is wrapped around the bucket and the snap hooks snapped onto the bucket handle, the pockets of the tool holder face upwardly to receive and carry tools.

U.S. Pat. No. D358,937, Invented by Duckworth, Titled "Basket Liner"

In the patent to Duckworth, an ornamental design for a basket liner is shown and described.

U.S. Pat. No. D345,237, Invented by Stein, Titled "Tool Pouch For Bucket"

In the patent to Stein, an ornamental design for a tool pouch for bucket is shown and described.

U.S. Pat. No. D355,062, Invented by Maire, et. al., Titled "Tool Carrier"

In the patent to Maire, an ornamental design for a tool carrier is shown and described.

U.S. Pat. No. D388,919, Invented by Maire, et. al., Titled "Bucket Mounted Tool Carrier"

In the patent to Maire, an ornamental design for a bucket mounted tool carrier is shown and described.

As outlined above, the prior art patents that relate to tool holding attachments for large containers largely entail elements such as: a tool holder and storage device to interfit over the upper rim of a five gallon bucket; a portable tool case has at least two canvas panels attached together; a tool and fastener holder with detachable holding belt; and an ornamental design for a basket liner.

In contrast, the present invention utilizes a tool holding means removably attachable to a rectangular crate with an open top portion. Unlike in the prior art, the device of the present invention includes multiple handles within the main walls of the container, rather than a simple pail handle that in unsuitable for carrying heavy loads. Moreover, the device may include a means to removably attach the tool holder to the crate that takes advantage of the holes already embodied in the standard crate. Using the side wall holes to secure the tool holder will ensure that the holder will not slip along the outer or inner edge of the crate.

SUMMARY OF THE INVENTION

As previously noted, the present invention is pliable tool holding apparatus that is removably attachable to a rectangular crate with an open top portion, such as a standard milk crate. Accordingly, the device of includes multiple handles within the main walls of the crate, allowing the user to carry heavy loads with both hands. In addition, the device may include a means to removably attach the tool holder to the crate by way of the holes embodied within in the standard crate side walls, functioning to keep the holder from slipping along the outer or inner edge of the crate. Moreover, the present invention may include separate removable compartments, and may include a varying quantity of compartments or pockets, of varying sizes and configurations, each suitable for particular tools and implements.

The prior art provides mostly cylindrical buckets with tool holding attachments, which are typically either cumbersome and heavy or limited in the type of items that can be contained therein. The most significant drawback to buckets with tool attachments is that such rely on the usage of a semi-spherical handle extending from the upper surface thereof, a configuration most suitable for carrying with a single hand. Thus, there is a significant need for the present invention, which provides a unique combination of large capacity of storage, greater ease of transport through the usage of multiple side wall handles, and user convenience.

With the foregoing in mind, it is the design of the present invention to provide a tool holding attachment device, which comprises outer pockets and inner pockets thereon, is draped over this crate upper lip portion and removably attached to the crate. The tool holding attachment device functions to removably receive multiple tools and implements therein, providing a unique tool organizing means for the user.

One feature taught by the present invention, then, is that it utilizes a standard milk crate constructed of a durable plastic with the ability to hold heavy items within its inner compartment.

Another feature of the present invention is that the crate may be rectangular or square in its configuration Another feature of the present invention is that the plurality of apertures appearing along the side walls of the crate may be utilized for effective anchoring of the tool holding attachment.

Another feature of the present invention is that the tool holding attachment device is generally pliable, and may be constructed of a canvas-type material.

Still another feature of the present invention is that any pockets of the tool holding attachment may comprise a closing means which functions to securely contain implements therein.

In addition, the invention may include a pocket attachment means which functions to allow pockets to be removably attached to the tool holding attachment device.

Another feature of the present invention is that the tool holding device may be removably secured to the traditional crate quickly and conveniently, in a variety of ways.

Moreover, in addition to the options mentioned above, one mode of manufacture of the present invention may include the tool attachment device functioning to line the entire interior portion of the crate, creating a means to cover the crate interior floor portion.

In another alternate embodiment, the tool attachment device functions to create a cover for the interior portion of the crate, allowing for the protection of items stored within the crate.

An additional feature of the present invention is that the tool attachment device may comprise indicia on both its outer pockets and inner pockets.

Lastly, it should be noted that the tool holding attachment itself is manufactured in such a manner as to fit over and removably attach to previously existing crates.

The novel features which are considered characteristic for the invention are set forth in the appended claims. The invention itself, however, both as to its construction and its method of operation, together with additional objects and advantages thereof, will be best understood from the following description of the embodiments when read and understood in connection with accompanying drawings.

BRIEF DESCRIPTION OF THE PREFERRED EMBODIMENT

DETAILED DESCRIPTION OF THE PREFERRED EMBODIMENT

Figure 1:
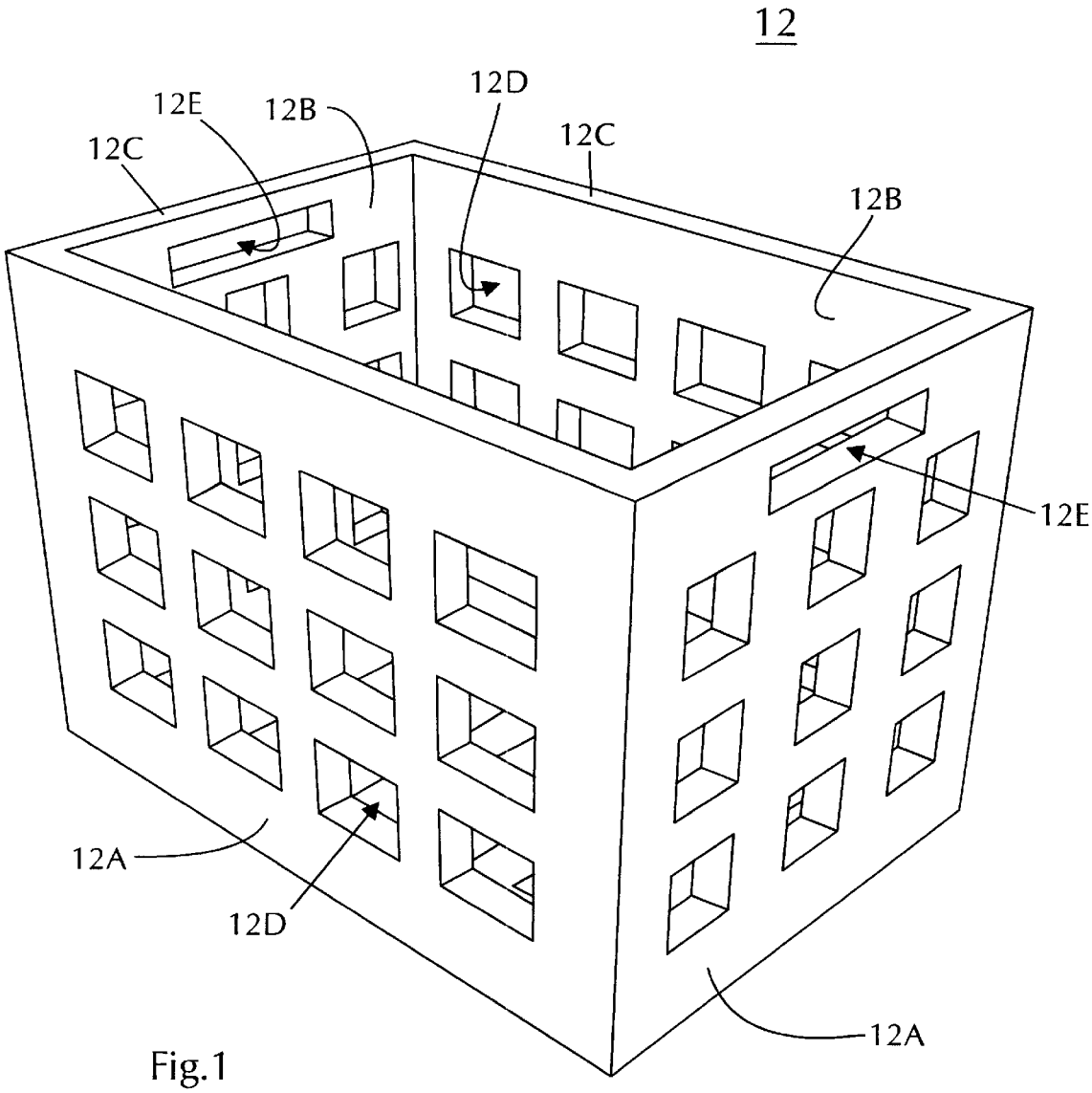
FIG. 1 is a three-quarter perspective view of a traditional crate to be retro-fitted with the device of the present invention.

Firstly, referring to FIG. 1, which is a three-quarter perspective view of a traditional crate to be retro-fitted with the device of the present invention: a crate device (12) with an exterior surface (12A) and an interior surface (12B) is provided. In the preferred mode, this crate (12) is a standard milk crate-style storage apparatus, constructed of a durable plastic with the ability to hold heavy items within its inner compartment. Other materials, however, may be used to construct the crate (12) of the present invention (10). The crate itself (12) may be substantially rectangular or square in its configuration, each of varying sizes according to the amount of implements (18) sought to be transported by the user.

In general, a plurality of handle apertures (12E) are located at an upper portion of the crate exterior surface (12A). Such may be in the form of two handles (12E) on opposing walls of the crate (12), or four total handles (12E), wherein one handle (12E) appears on each of the four side walls of the crate (12). Moreover, as is the case with standard mil-type crate devices, the exterior surface (12A) and interior surface (12B) comprise a plurality of apertures (12D) of a substantially similar size and shape, and the crate (12) further comprises an upper lip portion (12C) along the top periphery thereof.

Figure 2:
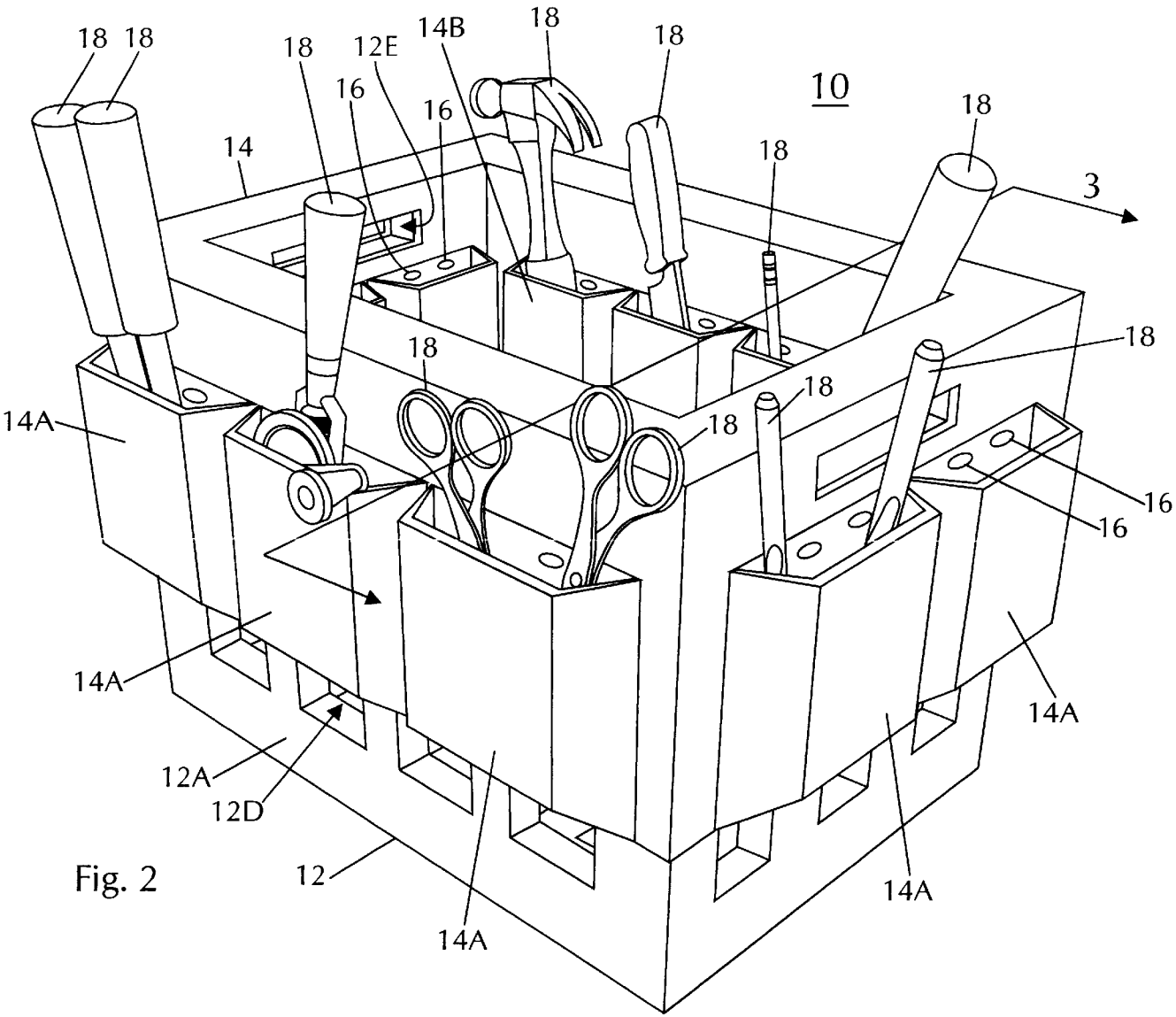
FIG. 2 is a three-quarter perspective view of the present invention, illustrating the tool holding attachment for crate device tightly draped over the upper lip portion of the crate in a rigid construction, for the purposes of example.
Figure 3:
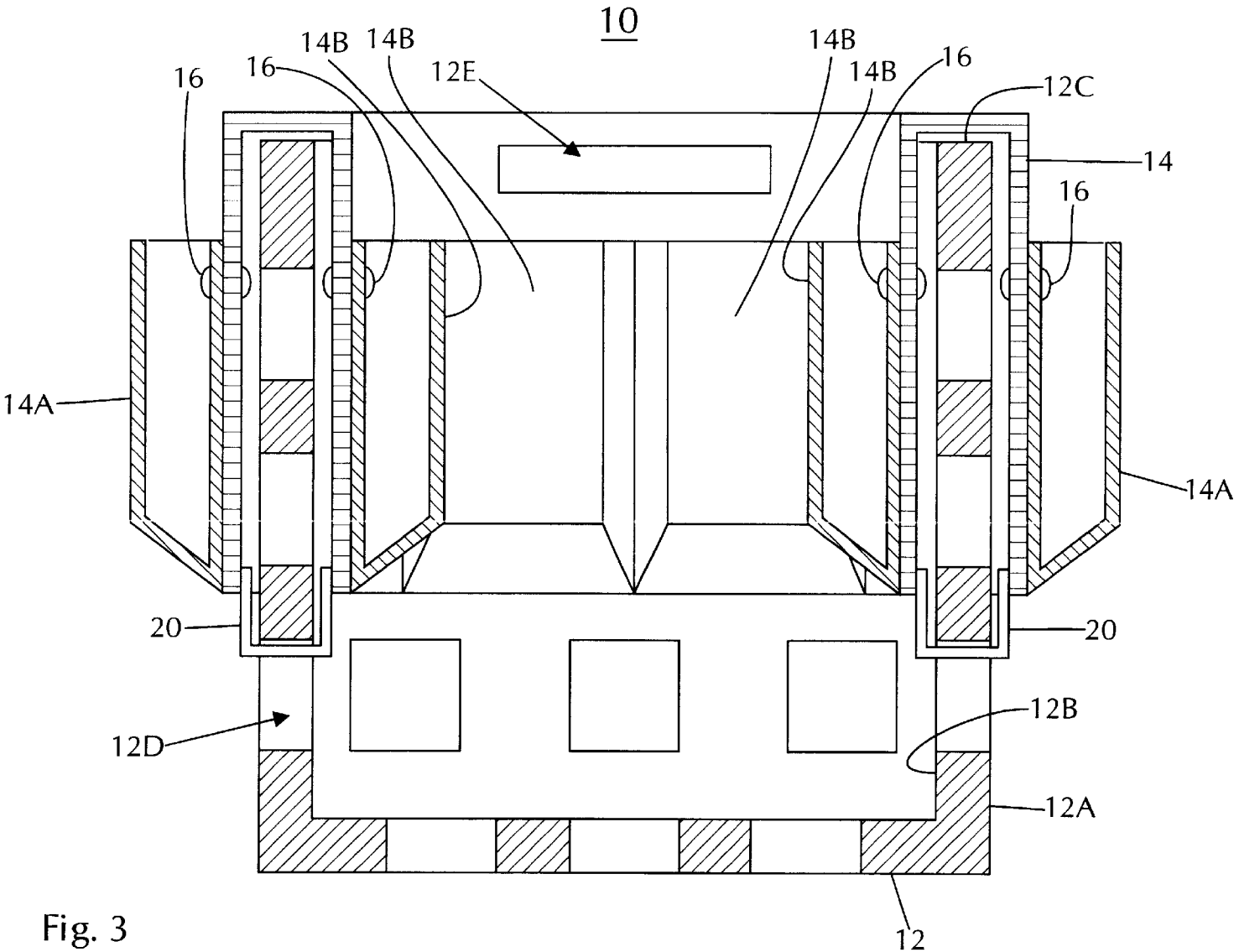
FIG. 3 is a cross-sectional view of the device of the present invention along line "3" of FIG. 2, exhibiting the pockets of the tool holding attachment in both the exterior and interior of the crate.

Next, referring to FIG. 2, which is a three-quarter perspective view of the present invention, illustrating the tool holding attachment for crate device tightly draped over the upper lip portion of the crate in a rigid construction, for the purposes of example; and FIG. 3 which is a cross-sectional view of the device of the present invention along line "3" of FIG. 2, exhibiting the pockets of the tool holding attachment in both the exterior and interior of the crate: a tool holding attachment device (14), which comprises outer pockets (14A) and inner pockets (14B) thereon, is draped over this crate upper lip portion (12C) and removably attached to the crate (12). The tool holding attachment device (14) functions to removably receive multiple tools and implements (18) therein, providing a unique tool organizing means for the user.

A pocket attachment means (16) functions to allow the outer pockets (14A) and inner pockets (14B) of the tool holding attachment device (14) to be removably attached to the tool holding attachment device (14). Thus, the user may interchange pockets and compartments for the crate device (10), according to what implements (18) are required for a particular job. Such also functions to reduce the weight of the device (10), as compartments that are not needed may be conveniently removed from the apparatus (10).

Importantly, an anchoring means (20) functions to secure the tool holding attachment device (14) to the crate (12) to prevent slippage therewith. Because the preferred embodiment includes the usage of a standard milk crate (12), the plurality of apertures (12D) appearing along the side walls of the crate (12) may be utilized for effective anchoring of the tool holding attachment (14).

In the preferred mode, the tool holding attachment device (14) is generally pliable, and may be constructed of a cnavas-type material. However, alternate materials, including water resistant or water-proof materials, may be draped over and attached to the crate (12).

In addition to the above, the tool holding attachment (14) may comprise multiple outer (14A) and inner (14B) pockets of varying size and varying containment capacity to removably store tools and implements (18) for a variety of tasks. For example, one embodiment may include substantially small tool-holding pockets (14A, 14B), a second embodiment may utilize substantially medium-sized compartments (14A, 14B), and a third embodiment may feature substantially large, removable pockets (14A, 14B) to provide the user with the utmost of versatility.

Any pockets (14A, 14B) of the tool holding attachment (14) may comprise a closing means which functions to securely contain implements (18) therein. For instance, pockets (14A, 14B) may include a snap-closing means, hook and loop fastening means, or zipper assembly to effectively contain substantially small items that may otherwise be easily misplaced.

Perhaps the greatest advantage of the present invention is that the tool holding device (14) may be removably secured to the traditional crate (12) quickly and conveniently, in a variety of ways. For instance, the anchoring means (20) may comprise a means to tie the tool holding attachment (14) to the crate (12) through usage of the crate apertures (12D). Alternatively, the anchoring means (20) may be a snap-fastening means, the tool attachment device (14) comprising male snap members on an outer surface thereof, and the crate (12) comprising female snap members along a surface of the upper lip member (12C). In addition, the anchoring means (20) may comprise hook and loop fasteners. Finally, the anchoring means (20) may comprise at least one elastic member securely engaging the periphery of the crate exterior surface (12A).

In an alternate embodiment, the tool holding device (14) functions to line the entire interior portion of the crate (12), creating a means to cover the crate interior floor portion. Such will allow for protection of the crate floor from corrosion or soiling, as well as provide a means to more adequately contain certain items and materials within the crate inner compartment. In another alternate embodiment, the tool holding device (14) functions to create a cover for the interior portion of the crate, allowing for the protection of items stored within the crate (12).

In the preferred mode, the holding device comprises (14) at least eight outer pockets (14A) and at least eight inner pockets (14B). In any such embodiment, the tool holding device (14) may comprise indicia on both its outer pockets (14A) and inner pockets (14B). Such indicia may be either in the form of advertising for particular brand names, or labeling for which types of implements (18) are most appropriate for which compartments (14A, 14B).

Finally, it should be noted that the tool holding attachment istelf (14) is manufactured in such a manner as to fit over and removably attach to previously existing crates (12). Such is tremendously beneficial to the user who may adapt the tool holding device (14) to selected crates (12) already owned or used by the user, functioning to allow the user to interchange tyhe device with certain crates (12) for certain tasks.

With regards to all FIGURES, while the invention has been illustrated and described as embodied, it is not intended to be limited to the details shown, since it will be understood that various omissions, modifications, substitutions and changes in the forms and details of the device illustrated and in its operation can be made by those skilled in the art without departing in any way from the spirit of the invention.

Without further analysis, the foregoing will so fully reveal the gist of the present invention that others can readily adapt it for various applications without omitting features that, from the standpoint of prior art, constitute essential characteristics of the generic or specific aspects of this invention. What is claimed as new and desired to be protected by Letters Patent is set forth in the appended claims.

What is claimed is:

1. A tool holding attachment for crate device comprising:

A. a crate comprising an exterior surface and an interior surface, the crate further comprising an upper lip portion, the exterior surface and interior surface comprising a plurality of apertures, the crate further comprising a plurality of handle apertures located at an upper portion of the crate exterior surface;

B. a tool holding attachment device comprising outer pockets and inner pockets thereon, the tool holding attachment device draped over the crate upper lip portion and removably attached to the crate, tool holding attachment device functioning to removably receive multiple tools and implements therein;

C. a pocket attachment means functioning to allow the outer pockets and inner pockets of the tool holding attachment device to be removably attached to the tool holding attachment device; and D. an anchoring means functioning to secure the tool holding attachment device to the crate to prevent slippage therewith.

2. The tool holding attachment for crate device as described in claim 1, wherein the crate is of a substantially rectangular configuration.

3. The tool holding attachment for crate device as described in claim 1, wherein the crate is of a substantially square configuration.

4. The tool holding attachment for crate device as described in claim 1, wherein the attachment means is a snap-fastening means, the tool attachment device comprising male snap members on an outer surface thereof, and the crate comprising female snap members along a surface of the upper lip member.

5. The tool holding attachment for crate device as described in claim 1, wherein the attachment means comprises hook and loop fasteners.

6. The tool holding attachment for crate device as described in claim 1, wherein the attachment means comprises at least one elastic member securely engaging the periphery of the crate exterior surface.

7. The tool holding attachment for crate device as described in claim 1, wherein the attachment means comprises a means to tie the tool holding attachment to the crate through usage of the crate apertures.

8. The tool holding attachment for crate device as described in claim 1, wherein the tool attachment device functions to create a cover for the crate.

9. The tool holding attachment for crate device as described in claim 1, wherein the tool attachment device functions to line the entire interior portion of the crate, creating a means to cover the crate interior floor portion.

10. The tool holding attachment for crate device as described in claim 1, wherein the tool attachment device is a generally pliable member.

11. The tool holding attachment for crate device as described in claim 1, wherein the tool attachment device comprises indicia thereon.

12. The tool holding attachment for crate device as described in claim 1, wherein the outer pockets comprise a closing means functioning to securely contain implements therein.

13. The tool holding attachment for crate device as described in claim 1, wherein the inner pockets comprise a closing means functioning to securely contain implements therein.

14. The tool holding attachment for crate device as described in claim 1, wherein two side walls of the crate comprise handle apertures at an upper portion thereon.

15. The tool holding attachment for crate device as described in claim 1, wherein four side walls of the crate comprise handle apertures at an upper portion thereon.

16. The tool holding attachment for crate device as described in claim 1, wherein the outer pockets and inner pockets vary in size and containment capacity.

17. The tool holding attachment for crate device as described in claim 1, wherein the outer pockets and inner pockets are identical in size and containment capacity.

18. The tool holding attachment for crate device as described in claim 1, wherein the device comprises at least eight outer pockets.

19. The tool holding attachment for crate device as described in claim 1, wherein the device comprises at least eight inner pockets.

20. The tool holding attachment for crate device as described in claim 1, wherein the device is manufactured in such a manner as to fit over and removably attach to previously existing crates.

* * * * *